US007793428B2

(12) United States Patent
Shenone

(10) Patent No.: US 7,793,428 B2
(45) Date of Patent: Sep. 14, 2010

(54) FOOTWEAR WITH REMOVABLE MIDSOLE HAVING PROJECTIONS

(75) Inventor: Dave Shenone, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 860 days.

(21) Appl. No.: 11/682,998

(22) Filed: Mar. 7, 2007

(65) Prior Publication Data

US 2008/0216360 A1 Sep. 11, 2008

(51) Int. Cl.
*A43B 13/00* (2006.01)

(52) U.S. Cl. ..... 36/25 R; 36/28

(58) Field of Classification Search ..... 36/25 R, 36/30 R, 59 R, 28
See application file for complete search history.

(56) References Cited

U.S. PATENT DOCUMENTS 997,657 A * 7/1911 Drake ..... 36/129
4,183,156 A 1/1980 Rudy
4,219,945 A 9/1980 Rudy
5,077,916 A * 1/1992 Beneteau ..... 361/114
5,343,639 A 9/1994 Kilgore et al.
5,353,523 A 10/1994 Kilgore et al.
5,367,791 A * 11/1994 Gross et al. ..... 36/31
5,595,003 A * 1/1997 Snow ..... 36/28
5,815,949 A * 10/1998 Sessa ..... 36/3 B
6,023,859 A 2/2000 Burke et al.
6,915,596 B2 * 7/2005 Grove et al. ..... 36/100
7,444,763 B2 * 11/2008 Grove et al. ..... 36/15
7,523,566 B2 * 4/2009 Young-Chul ..... 36/30 R
2005/0091881 A1 * 5/2005 Burgess ..... 36/30 R
2005/0210705 A1 * 9/2005 Grove et al. ..... 36/25 R
2005/0262739 A1 12/2005 McDonald et al.
2005/0268491 A1 * 12/2005 McDonald et al. ..... 36/28
2008/0250673 A1 * 10/2008 Andrews et al. ..... 36/25 R
2008/0263894 A1 * 10/2008 Nakano ..... 36/28
2009/0056172 A1 * 3/2009 Cho ..... 36/3 B

FOREIGN PATENT DOCUMENTS

WO 2004103105 A1 12/2004

OTHER PUBLICATIONS

International Preliminary Report on Patentability issued Sep. 17, 2009 in corresponding PCT No. PCT/US2008/055871.
Office Action issued Apr. 10, 2009 in corresponding Chinese Patent Application No. 200810007757.8, together with English translation thereof.

* cited by examiner

*Primary Examiner*—Marie Patterson
(74) *Attorney, Agent, or Firm*—Banner & Witcoff, Ltd.

(57) ABSTRACT

An article of footwear includes an upper and an upper plate secured to the upper and having a plurality of apertures formed therein. A removable midsole has a plurality of projections extending from a lower surface thereof, with each projection extending through one of the apertures of the upper plate.

19 Claims, 4 Drawing Sheets

FOOTWEAR WITH REMOVABLE MIDSOLE HAVING PROJECTIONS

FIELD OF THE INVENTION

This invention relates generally to footwear, and, in particular, to footwear with a removable midsole having projections received in apertures formed in an upper plate secured to an upper.

BACKGROUND OF THE INVENTION

Conventional articles of athletic footwear include an upper and a sole structure that are specifically designed for use in particular athletic activities. Running shoes, for example, incorporate a lightweight upper that provides the foot with ventilation, thereby decreasing the overall weight of the footwear and removing perspiration from the area surrounding the foot. Sole structures for running shoes are generally designed to provide a high degree of cushioning, which includes ground reaction force attenuation and energy absorption, and may incorporate motion control components for reducing the inward roll of the foot following footstrike. Basketball shoes generally incorporate an upper that protects the ankle from sprains and a sole that provides stability during the commonly executed lunges and quick direction changes. Finally, the sole structures for soccer shoes and football shoes may incorporate spikes that provide a high degree of traction on natural turf playing fields.

Despite the differences between the various footwear styles, sole structures for conventional footwear generally include multiple layers that are referred to as an insole, a midsole, and an outsole. The insole is a thin, cushioning member located adjacent to the foot that enhances footwear comfort. The midsole forms the middle layer of the sole and serves a variety of purposes that include controlling potentially harmful foot motions, such as over pronation; shielding the foot from excessive ground reaction forces; and beneficially utilizing such ground reaction forces for more efficient toe-off. The outsole forms the ground-contacting element of footwear and is usually fashioned from a durable, wear resistant material that includes texturing to improve traction.

The primary element of a commonly-employed type of conventional midsole is a resilient, polymer foam material, such as polyurethane or ethylvinylacetate, that extends throughout the length and width of the footwear. In designing the midsole, footwear manufacturers balance the manner in which the midsole provides cushioning with stability. In general, a relatively thick midsole will provide greater cushioning than a relatively thin midsole, but will also have less stability than the relatively thin midsole.

As an alternative, U.S. Pat. Nos. 5,353,523 and 5,343,639 to Kilgore et al., hereby incorporated by reference, discloses an article of athletic footwear with a midsole that includes foam columns placed between semi-rigid upper and lower plates. In general, the foam columns support the entire heel portion of the foot. The heel portion of a conventional article of footwear generally includes a block of foam material and may incorporate fluid-filled bladders, as disclosed in U.S. Pat. Nos. 4,183,156 and 4,219,945 to Rudy. In contrast, the heel portion of the footwear disclosed in the Kilgore patents includes foam columns and a void that extends through the columns. Unlike many conventional midsole materials, therefore, the foam columns generally utilize a foam with a higher density to provide greater support per unit-volume of foam material.

The performance characteristics of the foam columns disclosed in the Kilgore patents are primarily dependent upon factors that include the dimensional configurations of the columns and the properties of the foam material selected for the columns. By designing the columns to have specific dimensions and foam properties, cushioning and stability of the footwear may be generally tuned to meet the specific demands of the activity for which the footwear is intended to be used. In running shoes, for example, the dimensions and foam properties may be selected to provide greater cushioning. Similarly, the configuration of the columns may also be selected to provide enhanced stability in basketball shoes.

As stated above, cushioning and stability may be generally tuned to meet the specific demands of a particular activity. In general, the dimensions and foam properties will be selected to accommodate specific weights of the wearer, a generally preferred degree of cushioning, a particular activity, a specific ground surface, and a certain degree of motion control. A particular pair of footwear, however, may be purchased and worn by individuals with a wide range of weights that prefer different degrees of cushioning. In addition, the footwear may be used for varying activities on ground surfaces with a wide variety of compliance characteristics. In addition, different wearers may require different degrees of pronation or supination control.

It would be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear with a removable midsole having projections. In accordance with a first aspect, an article of footwear includes an upper and an upper plate secured to the upper and having a plurality of apertures formed therein. A removable midsole has a plurality of projections extending from a lower surface thereof, with each projection extending through one of the apertures of the upper plate.

In accordance with another aspect, an article of footwear includes an upper and an upper plate secured to the upper. A plurality of first apertures is formed in a forefoot portion of the upper plate. A plurality of second apertures is formed in a heel portion of the upper plate. A plurality of hollow support columns extends downwardly from the heel portion of the plate, with each hollow support column being one of transparent and translucent. A removable midsole has a plurality of first projections and a plurality of second projections. Each first projection is configured to extend through one of the first apertures in the upper plate, and each second projection is configured to extend through one of the second apertures in the upper plate and be received in one of the hollow support columns. Each of a plurality of outsole elements is secured to a lower surface of one of the support columns.

In accordance with a further aspect, an article of footwear includes an upper and an upper plate secured to the upper. A plurality of first apertures is formed in a forefoot portion of the upper plate. A plurality of second apertures is formed in a heel portion of the upper plate. A plurality of hollow support columns extends downwardly from the heel portion of the plate, with each hollow support column being one of transparent and translucent. A lower plate extends rearwardly from a midfoot portion of the upper plate and has a plurality of apertures formed therein, with each aperture receiving a portion of one of the hollow support columns. A removable midsole has a plurality of first projections and a plurality of second projections. Each first projection is configured to extend through one of the first apertures in the upper plate. The first projections are arranged in a plurality of rows extending substantially transversely across the midsole and a plurality of columns extending substantially longitudinally along the midsole. Each second projection is configured to extend through one of the second apertures in the upper plate and be received in one of the hollow support columns. Each of a plurality of first slits extends between adjacent rows of first projections. Each of a plurality of second slits extends between adjacent columns of first projections. Each of a plurality of outsole elements is secured to a lower surface of one of the support columns.

Substantial advantage is achieved by providing footwear with a removable midsole having projections. In particular, the removable midsole allows midsoles with different characteristics to be inserted and removed in the footwear when desired. For example, midsoles with different performance or aesthetic characteristics can be easily exchanged whenever desired by the user.

These and additional features and advantages disclosed here will be further understood from the following detailed disclosure of certain embodiments.

Figure 1:
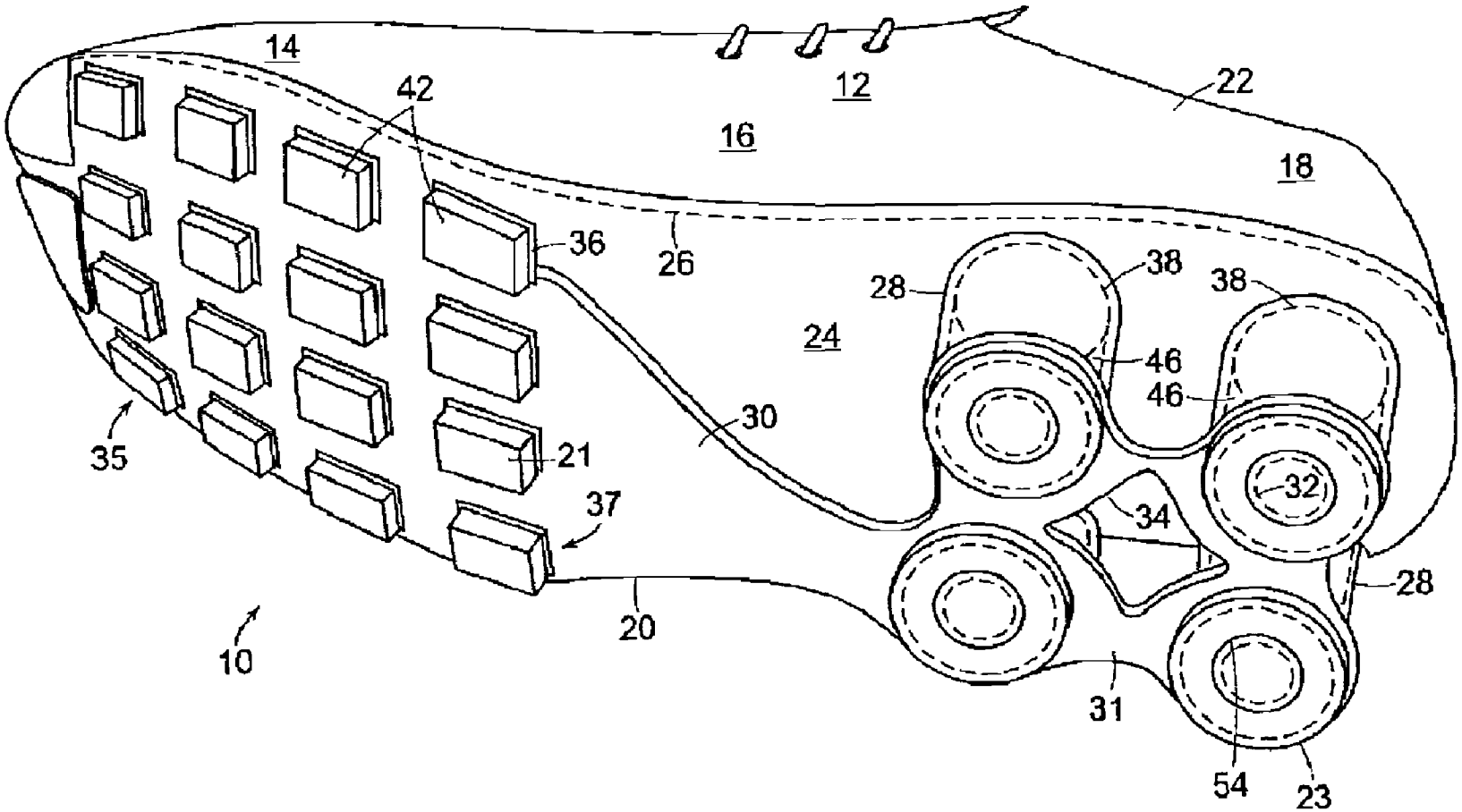
FIG. 1 is a perspective view of an article of footwear with a removable midsole having projections.

The figures referred to above are not drawn necessarily to scale and should be understood to provide a representation of the invention, illustrative of the principles involved. Some features of the footwear with a removable midsole having projections depicted in the drawings have been enlarged or distorted relative to others to facilitate explanation and understanding. The same reference numbers are used in the drawings for similar or identical components and features shown in various alternative embodiments. Footwear with a removable midsole having projections as disclosed herein would have configurations and components determined, in part, by the intended application and environment in which they are used.

DETAILED DESCRIPTION OF CERTAIN PREFERRED EMBODIMENTS

Figure 2:
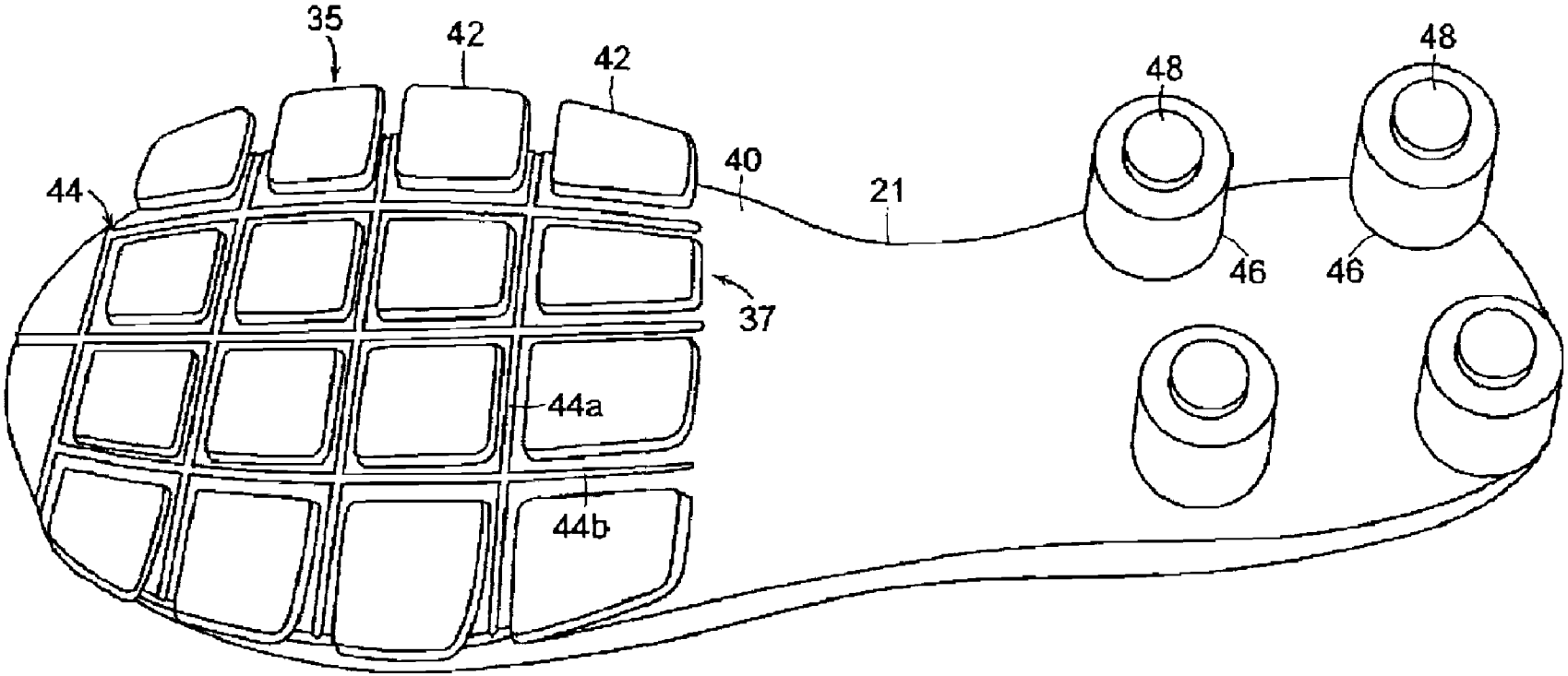
FIG. 2 is a perspective view of the lower side of the removable midsole of FIG. 1.
Figure 3:
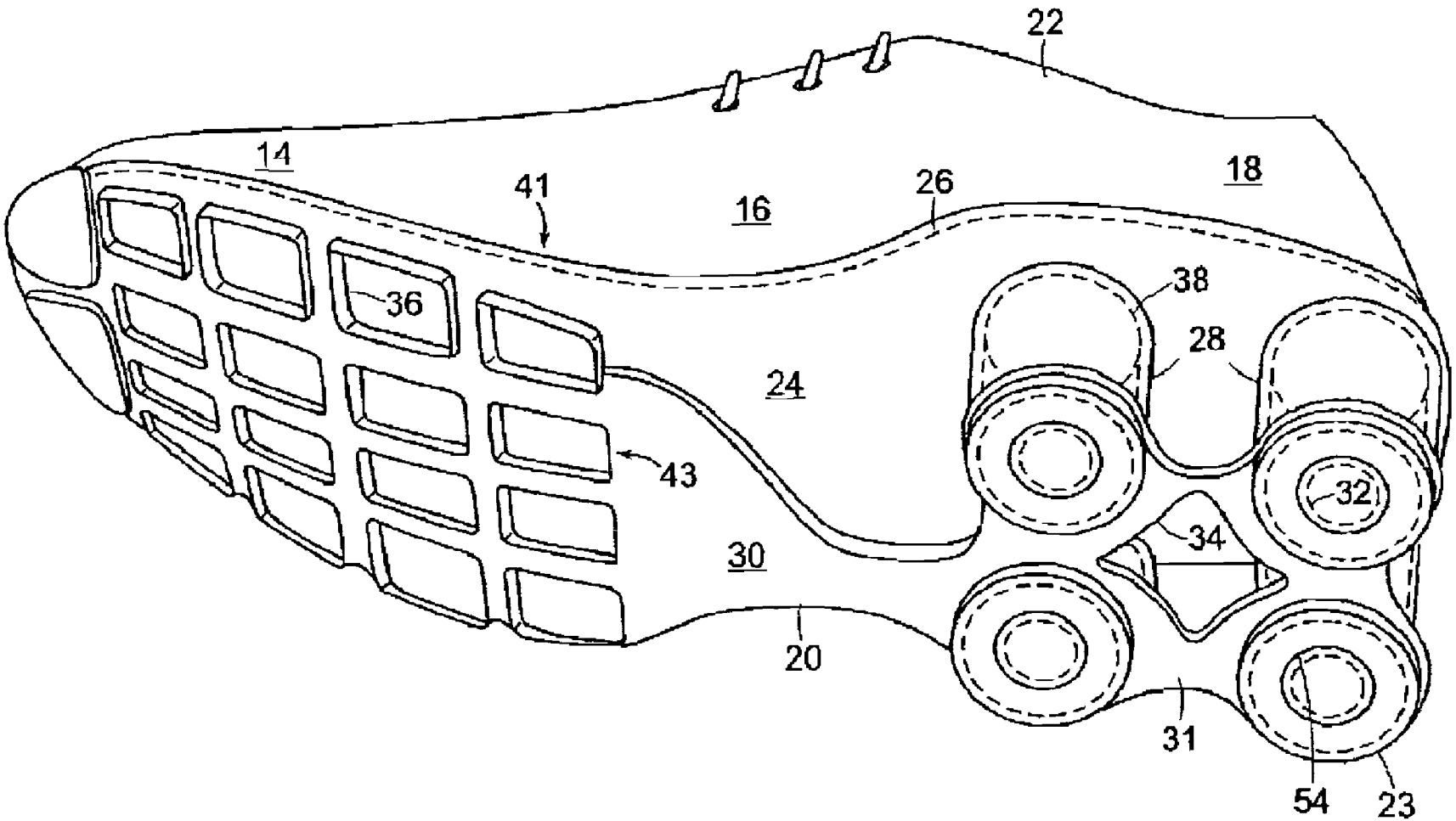
FIG. 3 is a perspective view of the article of footwear of FIG. 1, shown without the removable insert.

The present invention may be embodied in various forms. A preferred embodiment of an article of footwear 10 is shown in FIGS. 1-3. Footwear 10 includes an upper 12 that forms an interior void that comfortably receives a foot and secures the position of the foot. The configuration of upper 12, as depicted, is suitable for use during athletic activities, e.g., running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

For purposes of general reference, as illustrated here, footwear 10 may be divided into three general portions: a forefoot portion 14, a midfoot portion 16, and a heel portion 18. Portions 14, 16, and 18 are not intended to demarcate precise areas of footwear 10. Rather, portions 14, 16, and 18 are intended to represent general areas of footwear 10 that provide a frame of reference during the following discussion.

Footwear 10 also includes a lateral side 20 and a medial side 22. Forefoot portion 14 generally includes portions of footwear 10 corresponding with the toes and the joints connecting the metatarsals with the phalanges. Midfoot portion 16 generally includes portions of footwear 10 corresponding with the arch area of the foot, and heel portion 18 corresponds with rear portions of the foot, including the calcaneus bone. Lateral side 20 and medial side 22 extend through each of portions 14-18 and correspond with opposite sides of footwear 10. Portions 14-18 and sides 20-22 are not intended to demarcate precise areas of footwear 10. Rather, portions 14-18 and sides 20-22 are intended to represent general areas of footwear 10 to aid in the following discussion. Portions 14-18 and sides 20-22 may also be applied to upper 12 specifically, or any other portion of footwear 10.

As with conventional articles of footwear, sole assembly 14 includes an insole (not shown) located within upper 12, a midsole 21, and an outsole 23. Midsole 21 and functions as the primary shock-attenuating and energy-absorbing component of footwear 10.

Suitable materials for midsole 21 include resilient, polymer foam materials, such as polyurethane or ethylvinylacetate (EVA). Other suitable materials for midsole 21 will become readily apparent to those skilled in the art, given the benefit of this disclosure. Suitable materials for outsole 23 include traditional rubber materials. Other suitable materials for outsole 23 will become readily apparent to those skilled in the art, given the benefit of this disclosure.

In certain embodiments, footwear 10 may not include an outsole layer separate from midsole 21 but, rather, the outsole may comprise a bottom surface of midsole 21 that provides the external traction surface of sole assembly 14. In certain embodiments, outsole 23 may be made of a plurality of separate outsole elements secured to portions of footwear 10.

Unless otherwise stated, or otherwise clear from the context below, directional terms used herein, such as rearwardly, forwardly, top, bottom, inwardly, downwardly, upwardly, interior, exterior, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 18, that is, to the right as seen in FIG. 1. Naturally, forwardly is toward forefoot portion 14, that is, to the left as seen in FIG. 1, and downwardly is toward the bottom of the page as seen in FIG. 1. Top refers to elements toward the top of the page as seen in FIG. 1, while bottom refers to elements toward the bottom of the page as seen in FIG. 1. Inwardly or interior is toward the center of footwear 10, and outwardly or exterior is toward the outer peripheral edge of footwear 10.

An upper plate 24 is secured to a lower edge of upper 12. In the illustrated embodiment, upper plate 24 is secured about its upper peripheral edge to a lower peripheral edge of upper 12 with stitching 26. It is to be appreciated that upper plate 24 may be secured to upper 12 with adhesive or any other suitable fastening means. Upper plate 24 may be formed of a fairly rigid elastomeric material, such as lightweight, durable polymer materials having a moderate flexural modulus, e.g., polyester, nylon, a polyether block copolyamide (sold as Pebax® by ATOFINA Chemicals of Philadelphia, Pa.), or thermoplastic polyurethane (TPU). Upper plate 24 may also be formed of a composite material that is a combination of a polymer and a plurality of fibers or particulates, such as glass or carbon fibers. Other suitable materials for upper plate 24 will become readily apparent to those skilled in the art, given the benefit of this disclosure.

A plurality of hollow support columns 28 are provided in heel portion 18 and extend downwardly from the lower surface of upper plate 24. In certain embodiments, support columns 28 are co-injected with upper plate 24. In other embodiments, support columns 28 may be bonded to upper plate 24 with adhesive, for example. Other suitable fastening means for securing support columns 28 to upper plate 24 will become readily apparent to those skilled in the art, given the benefit of this disclosure.

Figure 4:
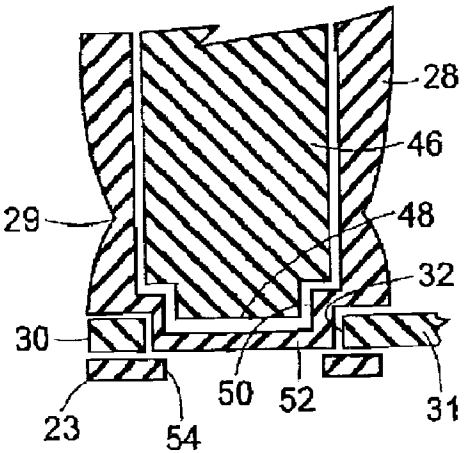
FIG. 4 is a section view of a support column of the article of footwear of FIG. 1, shown with a portion of the removable midsole housed therein.

In the illustrated embodiment, four (4) support columns 28 are provided in heel portion 18, with two support columns 28 being positioned on lateral side 20 and two support columns 28 being positioned on medial side 22 of heel portion 18. In certain embodiments, support columns 28 are formed of transparent or translucent materials. Such materials will allow a structure positioned within a support column 28 to be visible from the exterior of footwear 10. As seen in FIG. 4, the interior surface of support columns 28 substantially defines a cylinder. It is to be appreciated that the interior of support columns 28 may have other shapes as well.

In the illustrated embodiment, a reduced diameter, or necked portion 29 is formed in the exterior surface of each support column 28 proximate its lower end. Necked portions 29 serve to provide additional strength and shear resistance for support columns 28, as well as enhanced aesthetics.

In certain embodiments, support columns 28 may be formed of an elastomeric material such as TPU. Other suitable materials for support columns 28 will become readily apparent to those skilled in the art, given the benefit of this disclosure.

A lower plate 30 extends from a rear portion of forefoot portion 14 of upper plate 24, at a point where upper plate 24 extends upwardly and rearwardly providing a raised arch, rearwardly beneath upper plate 24. Lower plate 30 extends beneath and between support columns 28 in heel portion 18 of footwear 10, forming a web 31 between support columns 28. In the illustrated embodiment, lower plate 30 includes a plurality of first apertures 32, seen most clearly in FIG. 4, with each first aperture 32 exposing a central portion of the lower surface of a corresponding support column 28. A second aperture 34 is formed in lower plate 30, and is positioned in between support columns 28. In certain embodiments, second aperture 34 is substantially diamond-shaped. It is to be appreciated that second aperture 34 may have any desired shape.

Lower plate 30 may be formed of a fairly rigid elastomeric material, such as lightweight, durable polymer materials having a moderate flexural modulus, e.g., polyester, nylon, a polyether block copolyamide (sold as Pebax™ by ATOFINA Chemicals of Philadelphia, Pa.), or thermoplastic polyurethane (TPU). Lower plate 30 may also be formed of a composite material that is a combination of a polymer and a plurality of fibers or particulates, such as glass or carbon fibers. Other suitable materials for upper plate 24 will become readily apparent to those skilled in the art, given the benefit of this disclosure.

As seen most clearly in FIG. 3, upper plate 24 has a plurality of apertures formed therein. As seen in the embodiment illustrated here, a plurality of first apertures 36 are positioned in forefoot portion 14 in a grid-like pattern of transverse rows 35 extending substantially transversely across upper plate 24 and longitudinal columns 37 extending substantially longitudinally along upper plate 24. First apertures 36 are generally substantially rectangular in shape. The outer side of each first aperture 36 extending along both medial side 22 and lateral side 20, however, are slightly angled with respect to its transverse sides, in order to more closely match the curved sides of footwear 10. It is to be appreciated however, that first apertures 36 can have any desired shape.

A plurality of second apertures 38 are positioned in heel portion 18 of upper plate 24. In the illustrated embodiment, four (4) second apertures 38 are positioned in heel portion 18, two second apertures 38 being positioned on lateral side 20 and two second apertures 38 being positioned on medial side 22 of heel portion 18. It is to be appreciated that any number of second apertures 38 may be positioned in heel portion 18 of upper plate 24. Each second aperture 38 in heel portion 18 is in fluid communication with an interior of a support column 28. In the illustrated embodiment, second apertures 38 are substantially circular. It is to be appreciated however, that second apertures 38 can have any desired shape.

Removable midsole 21 includes a plurality of projections extending downwardly from its lower surface 40. A plurality of first projections 42 extend downwardly from forefoot portion 14 of midsole 21, and extend downwardly through first apertures 36 of upper plate 24, as seen in FIG. 1. In the illustrated embodiment, first projections 42 are generally substantially rectangular in shape. As noted above with respect to first apertures 36, the outer side of each first projection 42 extending along both medial side 22 and lateral side 20 are slightly angled with respect to its transverse sides, in order to more closely match the curved sides of footwear 10. It is to be appreciated however, that as with first apertures 36, first projections 42 can have any desired shape.

In the illustrated embodiment, first projections 42 are formed in a grid pattern of transverse rows 41 extending substantially transversely across midsole 21 and longitudinal columns 43 extending substantially longitudinally along midsole 21 to match that of first apertures 36. In forefoot portion 14 of footwear 10, first projections 42 of midsole 21 have no outsole elements 23 and, therefore, first projections 42 form the ground-engaging surface of footwear 10 in the forefoot portion 14 of footwear 10.

In certain embodiments, a plurality of slits 44 may be formed in lower surface 40 of midsole 21. In the illustrated embodiment, a plurality of first slits **44*a* extend substantially transversely across midsole 21, with each first slit 44*a* positioned between adjacent transverse rows 35 of first projections 42. Similarly a plurality of second slits 44*b* extend substantially longitudinally along midsole 21, with each second slit 44*b* positioned between adjacent longitudinal columns 37 of first projections 42. Slits 44 serve to make midsole 21 more flexible, thereby facilitating installing midsole within footwear 10** and removing it therefrom.

A plurality of second projections 46 extend downwardly from heel portion 18 of midsole 21. In the illustrated embodiment, four (4) second projections 46 are positioned in heel portion 18 of midsole 21, two second projections 46 being positioned on lateral side 20 and two second projections 46 being positioned on medial side 22 of heel portion 18 of midsole 21. It is to be appreciated that any number of second projections 46 may be positioned in heel portion 18 of midsole 21. Each second projection 46 is received in one of the hollow support columns 28, as seen in FIG. 4. In the illustrated embodiment, second projections 46 are substantially cylindrical. It is to be appreciated however, that second projections 46 can have any desired shape that mates with second apertures 38 within which second projections 46 are received.

In the illustrated embodiment, each second projection 46 has a tab 48 extending downwardly from its lower surface, which is received in a recess 50 formed in a corresponding projection 52 extending downwardly from the bottom of each support column 28, as seen in FIG. 4. Each projection 52 at the lower end of each support column 28 is captured in a corresponding first aperture 32 of lower plate 30.

An outsole element 23 is secured to the lower surface of lower plate 30 beneath each support column 28. Each outsole element 23 is substantially cylindrical with a central aperture 54 formed therein. Central apertures 54 allow visibility of support columns 28 and midsole 21 from the exterior of footwear 10.

Figure 5:
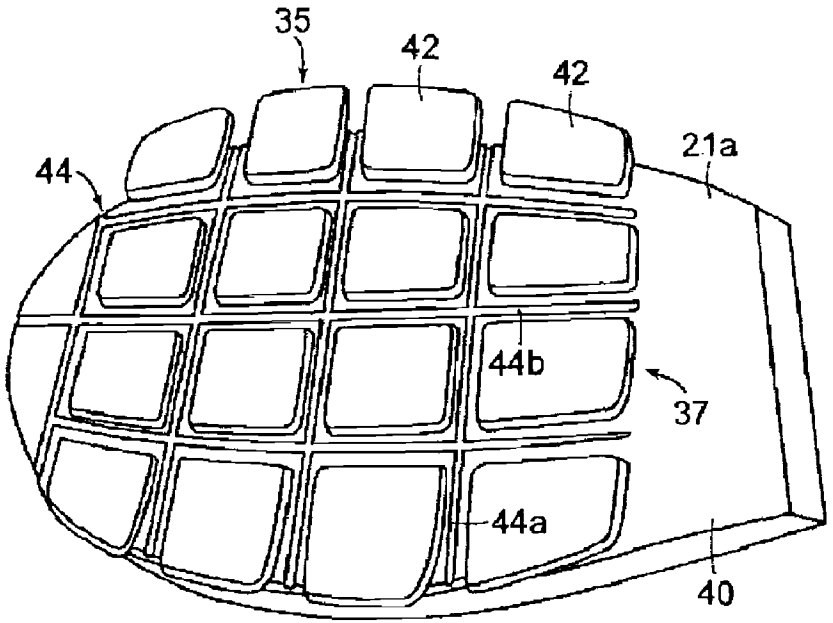
FIG. 5 is a perspective view of the lower side of an alternative embodiment of a removable insert for use with an article of footwear.

Another embodiment of a removable midsole is seen in FIG. 5, in which a midsole 21*a* is formed such that it extends only throughout forefoot portion 14 of footwear 10. The remainder of the midsole in such an embodiment would not be removable, and is fixed within footwear 10 in a conventional manner. Midsole 21*a* has the same configuration as that described above with respect to the forefoot portion 14 of midsole 21, that is, it includes the plurality of first projections 42 that are received in first apertures 36 and slits 44.

Figure 6:
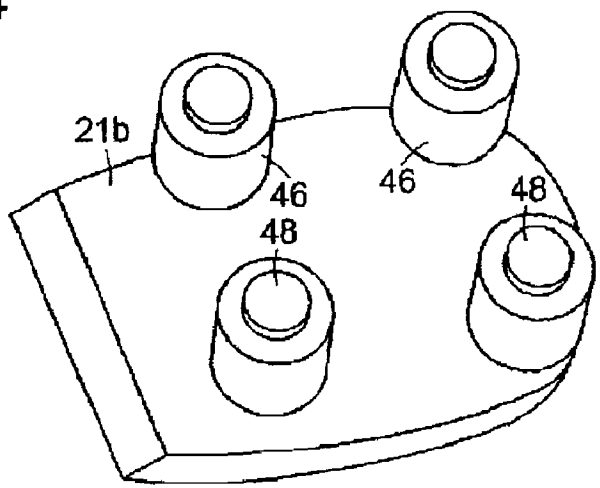
FIG. 6 is a perspective view of the lower side of another alternative embodiment of a removable insert for use with an article of footwear.

A further embodiment of a removable midsole is seen in FIG. 6, in which a midsole 21*b* is formed such that it extends only throughout heel portion 18 of footwear 10. The remainder of the midsole in such an embodiment would not be removable, and is fixed within footwear 10 in a conventional manner. Midsole 21*b* has the same configuration as that described above with respect to the heel portion 18 of midsole 21, that is, it includes the plurality of second projections 46 that are received in second apertures 38.

Since midsole 21 is removable, midsoles with different characteristics can easily be exchanged within footwear 10. Thus, the performance characteristics of footwear 10 can be altered by replacing one midsole 21 with a given performance characteristic with a midsole 21 having a different performance characteristic. For example, midsoles 21 with different densities or durometers can be exchanged with one another, thereby altering the support of midsole 21. By selecting a desired midsole 21, the cushioning and stability of footwear 10 may be generally tuned to meet the specific demands of a particular activity. In general, the characteristics or properties of midsole 21 can be selected to accommodate various parameters, such as the specific weight of the wearer, a generally preferred degree of cushioning, a preferred degree of pronation or supination control, a particular activity, a specific ground surface, or a certain degree of motion control, for example. In addition, the footwear may be used for varying activities on ground surfaces with a wide variety of compliance characteristics. Thus, it can be appreciated that replaceable midsoles 21 with any desired performance characteristics can be selected and easily exchanged.

Since support columns 28 are translucent or transparent, second projections 46 of midsole 21 are visible from the exterior of footwear 10 in heel portion 18 of footwear 10. Additionally, since first projections 42 extend outwardly through upper plate 24 and form the ground-engaging surface of footwear 10 in forefoot portion 14, midsole 21 is visible from the exterior of front portion 14 of footwear 10. Consequently, a change in the appearance of midsole 21 will be visible from the exterior of footwear 10. Accordingly, the removability of midsoles 21 also allows midsoles 21 with different aesthetic characteristics to be easily exchanged in footwear 10. For example, midsoles 21 of different colors can easily be exchanged in footwear 10, thereby varying the aesthetic appearance of footwear 10. Midsoles 21 with other aesthetic characteristics including texture, for example, can similarly be exchanged.

Thus, it can be seen that through the use of a removable midsole 21, the aesthetic appearance and/or performance characteristics of footwear 10 can easily be altered by the user.

Certain embodiments of the present invention are particularly useful in systems that allow users or customers to have footwear custom-manufactured. The ability to remove and exchange midsole 21 is particularly suited for providing footwear that is optimized for a particular user.

U.S. patent application Ser. No. 11/420,926, filed on May 30, 2006 and entitled "Custom Ordering of an Article," the entire disclosure of which is incorporated herein, describes a system and method with a graphical user interface for customizing an article. The system may be accessed by a user through the Internet, for example. The graphical user interface includes an analog-style selection control that allows a user to select at least one characteristic of a feature of the article. Thus, the color, density, or any other characteristic of removable midsole 21 could be selected with such a system.

U.S. patent application Ser. No. 09/721,445, filed on Nov. 21, 200 and entitled "Method and System for Custom Manufacturing Items Such as Footwear", "the entire disclosure of which is incorporated herein, describes a system and method for allowing a customer to custom-order an item, such as shoes. The system and method may allow the retailer to control the selection of choices given to the customer for custom-manufacturing an item, so that the retailer can maintain some control over the appearance and/or structural components of the custom-manufactured item. The selection of a particular removable sole by the customer can be done through such a system and method.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper;

an upper plate secured to the upper and having a plurality of apertures formed therein;

a removable midsole having a plurality of projections extending from a lower surface thereof, each projection extending through one of the apertures of the upper plate; and a plurality of hollow support columns extending downwardly from a heel portion of the upper plate, each hollow column receiving one of the projections.

2. The article of footwear of claim 1, wherein the hollow support columns are one of translucent and transparent.

3. The article of footwear of claim 1, further comprising a lower plate extending rearwardly from a midfoot portion of the upper plate and beneath the upper plate, the lower plate being connected to the hollow support columns.

4. The article of footwear of claim 3, wherein the lower plate includes a first aperture in a central portion thereof.

5. The article of footwear of claim 1, wherein the projections comprise a plurality of first projections in a forefoot portion of the midsole and a plurality of second projections in a heel portion of the midsole.

6. The article of footwear of claim 5, wherein the first projections are arranged in a plurality of rows extending substantially transversely across the midsole and a plurality of columns extending substantially longitudinally along the midsole.

7. The article of footwear of claim 6, further comprising a plurality of slits in a lower surface of the midsole.

8. The article of footwear of claim 7, wherein each of a plurality of first slits extends between adjacent rows of first projections and each of a plurality of second slits extends between adjacent columns of first projections.

9. The article of footwear of claim 5, wherein at least some of the first projections and first apertures are substantially rectangular.

10. The article of footwear of claim 5, wherein the second projections are substantially cylindrical.

11. The article of footwear of claim 10, wherein each second projection includes a circular tab on its lower surface.

12. The article of footwear of claim 1, wherein the upper plate is secured to the upper with stitching.

13. The article of footwear of claim 1, wherein the removable midsole extends through only a forefoot portion of the footwear.

14. The article of footwear of claim 1, wherein the removable midsole extends through only a heel ion of the footwear.

15. An article of footwear comprising, in combination:

an upper;

an upper plate secured to the upper;

a plurality of first apertures formed in a forefoot portion of the upper plate;

a plurality of second apertures formed in a heel portion of the upper plate;

a plurality of hollow support columns extending downwardly from the heel portion of the plate, each hollow support column being one of transparent and translucent;

a removable midsole having a plurality of first projections and a plurality of second projections, each first projection configured to extend through one of the first apertures in the upper plate, and each second projection configured to extend through one of the second apertures in the upper plate and be received in one of the hollow support columns, and a plurality of outsole elements, each outsole element secured to a lower surface of one of the support columns.

16. The article of footwear of claim 15, wherein the first projections are arranged in a plurality of rows extending substantially transversely across the midsole and a plurality of columns extending substantially longitudinally along the midsole.

17. The article of footwear of claim 16, further comprising:

a plurality of first slits, each first slit extending between adjacent rows of first projections; and a plurality of second slits, each second slit extending between adjacent columns of first projections.

18. The article of footwear of claim 15, wherein at least some of the first projections and first apertures are substantially rectangular, and the second projections are substantially cylindrical.

19. An article of footwear comprising, in combination:

an upper;

an upper plate secured to the upper;

a plurality of first apertures formed in a forefoot portion of the upper plate;

a plurality of second apertures formed in a heel portion of the upper plate;

a plurality of hollow support columns extending downwardly from the heel portion of the plate, each hollow support column being one of transparent and translucent;

a lower plate extending rearwardly from a midfoot portion of the upper plate and having a plurality of apertures formed therein, each aperture receiving a portion of one of the hollow support columns;

a removable midsole having a plurality of first projections and a plurality of second projections, each first projection configured to extend through one of the first apertures in the upper plate, the first projections being arranged in a plurality of rows extending substantially transversely across the midsole and a plurality of columns extending substantially longitudinally along the midsole, and each second projection configured to extend through one of the second apertures in the upper plate and be received in one of the hollow support columns;

a plurality of first slits, each first slit extending between adjacent rows of first projections;

a plurality of second slits, each second slit extending between adjacent columns of first projections; and a plurality of outsole elements, each outsole element secured to a lower surface of one of the support columns.

* * * * *

UNITED STATES PATENT AND TRADEMARK OFFICE

CERTIFICATE OF CORRECTION

PATENT NO. : 7,793,428 B2
APPLICATION NO. : 11/682998
DATED : September 14, 2010
INVENTOR(S) : Dave Shenone It is certified that error appears in the above-identified patent and that said Letters Patent is hereby corrected as shown below:

Column 9, line 37 claim 14, replace "heel ion" with --heel portion--.

Signed and Sealed this

Ninth Day of November, 2010

David J. Kappos

David J. Kappos
*Director of the United States Patent and Trademark Office*